US006501351B1

(12) United States Patent
Gasnier

(10) Patent No.: US 6,501,351 B1
(45) Date of Patent: Dec. 31, 2002

(54) RADIOELECTRIC TRANSMISSION SYSTEM PROVIDED WITH A ROTATING PART AND A PART FIXED TO AN ANTENNA EXTENDING OVER TWO CIRCLES

(75) Inventor: Philippe Jacques René Gasnier, Nanterre (FR)

(73) Assignee: Hispano Suiza, Colombes (FR)

( * ) Notice: Subject to any disclaimer, the term of this patent is extended or adjusted under 35 U.S.C. 154(b) by 0 days.

(21) Appl. No.: 09/890,269

(22) PCT Filed: Dec. 14, 2000

(86) PCT No.: PCT/FR00/03520

§ 371 (c)(1),
(2), (4) Date: Aug. 9, 2001

(87) PCT Pub. No.: WO01/45202

PCT Pub. Date: Jun. 21, 2001

(30) Foreign Application Priority Data

Dec. 16, 1999 (FR) ..... 99 15878

(51) Int. Cl.[7] ..... H01P 1/06
(52) U.S. Cl. ..... 333/256; 333/261; 343/763
(58) Field of Search ..... 333/256, 261, 333/24 R, 257; 343/763

(56) References Cited

U.S. PATENT DOCUMENTS

| | | | | |
|---|---|---|---|---|
| 2,894,220 A | * | 7/1959 | Ridgers et al. | 333/24 R |
| 3,013,225 A | | 12/1961 | Ouchi | 333/24 R |
| 4,538,125 A | * | 8/1985 | Beckmann et al. | 333/248 |
| 4,730,224 A | | 3/1988 | Komatsu | 360/64 |

FOREIGN PATENT DOCUMENTS

| | | |
|---|---|---|
| DE | 1 138 437 | 10/1962 |
| DE | 196 10 628 | 8/1997 |
| GB | 2 328 086 | 2/1999 |

* cited by examiner

*Primary Examiner*—Michael Tokar
*Assistant Examiner*—James H Cho
(74) *Attorney, Agent, or Firm*—Oblon, Spivak, McClelland, Maier & Neustadt, P.C.

(57) ABSTRACT

The installation comprises a part (1) rotating about a fixed part (2) and provided with measurement instruments (3) with antennas (5) aimed radially towards a fixed antenna (6). This antenna comprises two pairs of arms (9, 10, 14, 15) in two concentric circles, and the spaces (13, 18) between the free ends of the pairs of arms are located at different angular positions so that signals emitted by the antennas (5) always arrive at one of the pairs of arms and supply a clear and distinct signal.

1 Claim, 1 Drawing Sheet

RADIOELECTRIC TRANSMISSION SYSTEM PROVIDED WITH A ROTATING PART AND A PART FIXED TO AN ANTENNA EXTENDING OVER TWO CIRCLES

BACKGROUND OF THE INVENTION

The invention described herein relates to a radioelectric transmission installation comprising a fixed part and a rotating part, remarkable due to the shape of one antenna in the fixed part which is arranged in the form of two concentric circles.

This type of installation can be useful in some range finding equipment in which one or more measurement instruments are installed to rotate about a fixed base. The measurement instrument is provided with a modulator itself provided with a rotating antenna aimed towards an antenna fixed to the base and connected to a demodulator that collects the signals from the measurement instrument. The rotating antenna is aimed towards the axis of rotation of the rotating part and one known form of the fixed antenna is in the shape of a folded T, in other words it is composed of a pair of curved arms each extending around almost half a circumference starting from their junction, as far as the ends facing each other and separated by a small angular space.

But this space is the source of signal disturbances when the rotating antenna passes in front of it, which is why the inventors wanted to improve this type of radioelectric installation and to design the fixed antenna described herein.

SUMMARY OF THE INVENTION

The installation proposed here is innovative in that it comprises a fixed antenna in the shape of what could be called a folded double T, composed of two pairs of curved arms laid out on two concentric circles; once again, the arms of each of the pairs extend around almost half a circumference, but the spaces between the free ends of each of the pairs are not in the same angular position, measured from the axis of rotation, without any overlap.

DETAILED DESCRIPTION OF THE INVENTION

Figure 1:
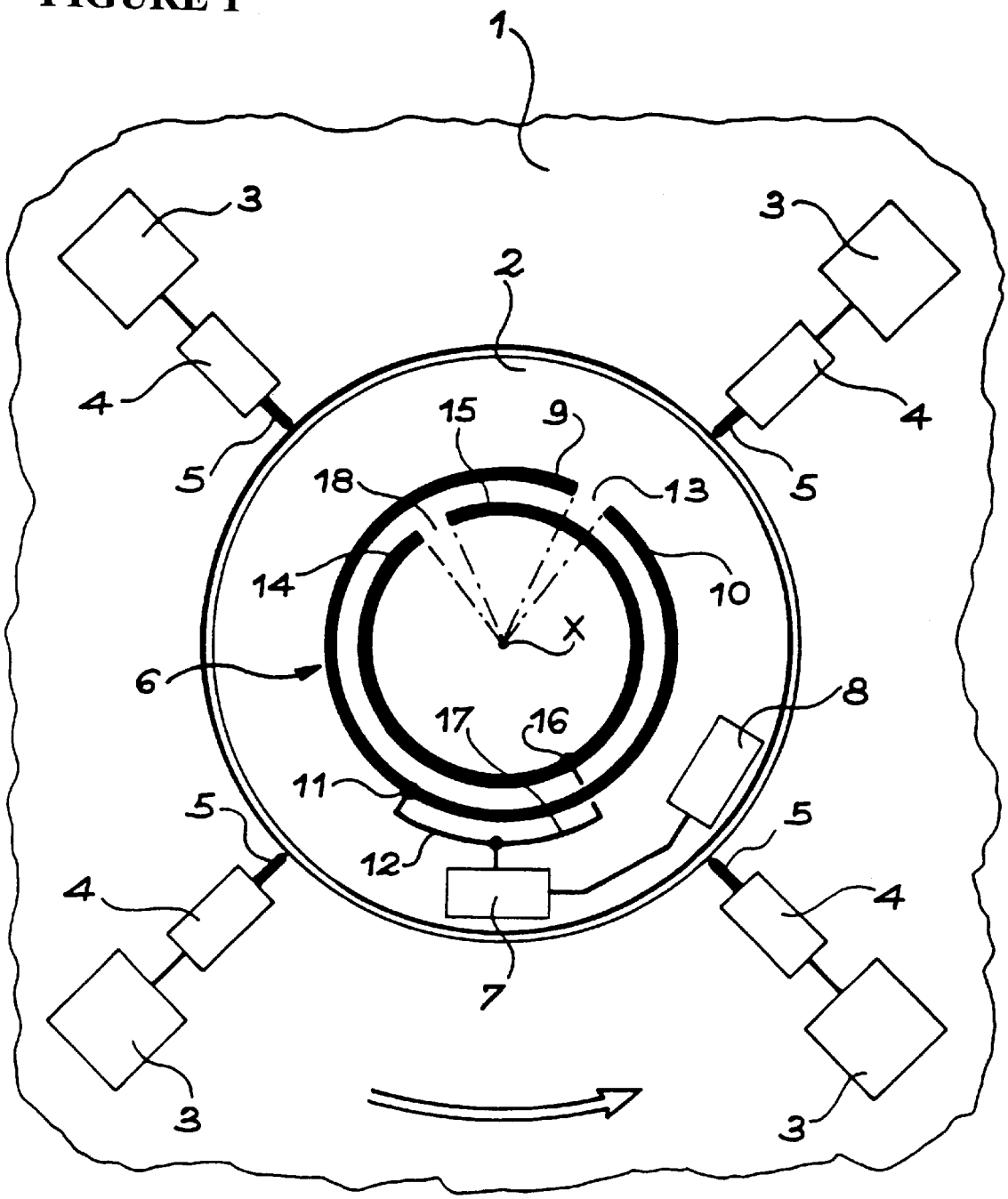
FIG. 1 is a radioelectronic transmission installation according to the invention.

FIG. 1 and the detailed commentary of the embodiment of the invention make it easy to understand its operation and advantages.

The radioelectric transmission device may comprise an annular shaped rotating part 1 arranged around a fixed base 2 that is rotating about an X-axis by means not shown. The mobile part 1 comprises some measurement instruments 3 (their number is not critical, and it is possible to have only one), each instrument being connected to a corresponding signal modulator 4 provided with an antenna 5 facing the X-axis. Each of the modulators 4 transmits a signal at a different frequency from its antenna 5 to the same fixed wire antenna 6 located on the base 2. The fixed antenna 6 is connected to a demodulator 7, itself connected to an operating device 8 appropriate for the application, capable of separating, processing and interpreting the signals from the different measurement instruments 3.

The fixed antenna 6 is composed of four arms; two of these arms 9 and 10 each extend over almost half a circumference from a common junction end 11, where they are connected to a conductor 12 leading to the demodulator 7, until reaching a space 13 with a small angular distance that extends between their distal remote ends; the other two arms 14 and 15 also extend over almost half a circumference from a junction 16 connected by another conductor 17 to demodulator 7 as far as another space 18 between their free ends. The pairs of arms 9, 10 and 14, 15 mentioned above are located on concentric circles, the center of which passes through the X-axis of rotation of the rotating part 1.

Since the spaces 13 and 18 cover angular positions without any overlap, the signals transmitted by rotating antennas 5 always reach at least one of the arms 9, 10 and 14, 15 of the fixed antenna 6; therefore, an unmodified signal reaches the demodulator 7 through at least one of the conductors 12 and 17, which gives good quality reception for all angular positions of the rotating part 1, which is contrary to what was observed in prior art.

I claim:

1. Radioelectric transmission installation comprising a fixed part and a rotating part rotating about an axis and in front of the fixed part, the fixed part comprising a fixed antenna and the rotating part comprising a rotating antenna aimed at the fixed antenna, characterized in that the fixed antenna comprises two pairs of curved arms connected to the same operating instrument, the pairs of curved arms extending over corresponding concentric circles except at the spaces between the free ends of the arms of each of the pairs, the spaces extending over angular positions without any overlap when seen from the axis.

* * * * *